United States Patent [19]

Van Heyningen

[11] 4,381,342

[45] Apr. 26, 1983

[54] LIQUID JET METHOD FOR COATING PHOTOGRAPHIC RECORDING MEDIA

[75] Inventor: Roger S. Van Heyningen, Rochester, N.Y.

[73] Assignee: Eastman Kodak Company, Rochester, N.Y.

[21] Appl. No.: 258,154

[22] Filed: Apr. 27, 1981

[51] Int. Cl.[3] ..... B05D 1/04; B05D 1/06; B05D 5/00; G03C 1/76

[52] U.S. Cl. ..... 430/496; 430/935; 346/75; 427/14.1; 427/28

[58] Field of Search ..... 427/14.1, 28, 230, 256; 346/75; 430/935, 495, 496

[56] References Cited

U.S. PATENT DOCUMENTS

| | | | |
|---|---|---|---|
| 2,600,129 | 6/1952 | Richards | 346/75 |
| 3,484,793 | 12/1969 | Weigl | 346/75 |
| 3,560,641 | 2/1971 | Taylor et al. | 346/75 |
| 4,314,259 | 2/1982 | Cairns et al. | 346/75 |

*Primary Examiner*—Mary F. Downey
*Attorney, Agent, or Firm*—John D. Husser

[57] ABSTRACT

A method of coating a photographic support with photographic material includes moving the support past a coating zone at a substantially constant velocity and generating a stream of equally sized and spaced drops of photographic coating liquid toward the coating zone so that the liquid is deposited at discrete, uniformly sized and spaced, sites of predetermined pitch.

14 Claims, 3 Drawing Figures

FIG. 1
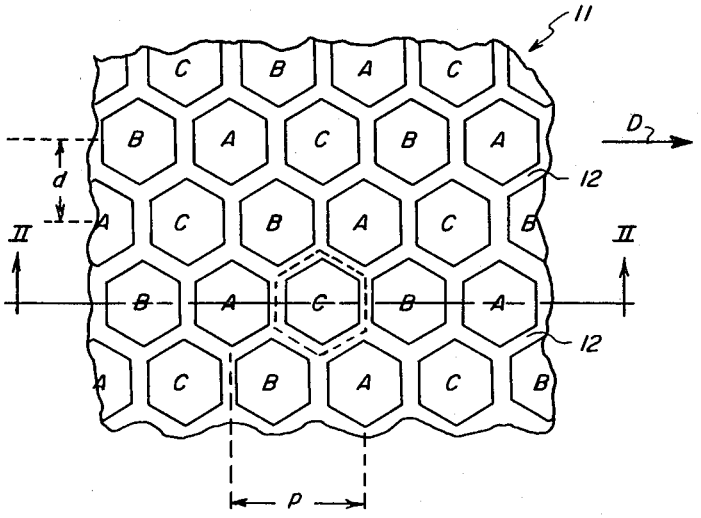
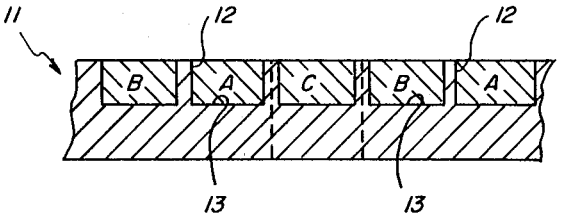
FIG. 2

LIQUID JET METHOD FOR COATING PHOTOGRAPHIC RECORDING MEDIA

CROSS-REFERENCE TO RELATED APPLICATIONS

Reference is hereby made to U.S. patent application Ser. No. 184,714, entitled "Imaging with Nonplanar Support Elements" and filed Sept. 8, 1980 in the name of K. E. Whitmore.

BACKGROUND OF THE INVENTION

1. Field of the Invention

The present invention relates to improvements in the fabrication of photographic recording media and more specifically to a method for applying photographic coating liquids to a photographic support.

2. Description of the Prior Art

U.S. patent application Ser. No. 184,714 entitled "Imaging with Nonplanar Support Elements" and filed Sept. 8, 1980 in the name of K. E. Whitmore, discloses a variety of new and improved configurations and modes for photographic imaging. One characteristic of this innovative approach is an imaging element having a nonplanar support surface whereon a network of cell walls defines a plurality of tiny, discrete microcells or microvessels. This approach affords a number of significant advantages for photographic imaging, including elimination or reduction of lateral image spreading, e.g. due to light spread during exposure or reactant migration during processing. Various of the embodiments disclosed in that application feature elements in which individual cells respectively contain different photographic imaging materials, e.g. different radiation-sensitive materials, dye image formers or filter colorants arranged in a predetermined pattern.

In accordance with the teachings of the aforementioned Whitmore application, the fabrication of such photographic elements can be implemented by first filling all cells with a selectively removable material, then successively emptying and refilling different cell groups respectively with the different kinds of photographic materials. One exemplary mode for such selective emptying is to modulate a scanning laser beam to selectively sublime or melt the contents of a particular cell group. The element is next coated by conventional techniques so that the emptied cell group is filled with a first photographic material. Selective emptying of a second group of cells next occurs, followed by their filling with a second photographic material, etc.

Although the above-described fabrication technique is completely operable and possesses certain advantages, it will be appreciated that it requires a fairly large number of process steps and related fabricating stations.

SUMMARY OF THE INVENTION

The present invention provides an advantageous alternative mode for fabricating photographic elements of the kind described above or other similar elements. Thus, in one aspect the present invention provides an improved method for coating different photographic materials in a predetermined pattern on a photographic support. In a related aspect the present invention provides an improved method for depositing coating material at discrete, predetermined sites, e.g. within cell walls, on a surface of a photographic support.

In general these advantageous aspects of the present invention are accomplished by moving the photographic support past a coating zone at a substantially constant velocity and generating a stream(s) of equally sized and spaced drops of photographic coating liquid, directed toward the coating zone. The rate of drop generation is synchronized with the support movement so that drops are deposited at predetermined locations on the support. In certain preferred embodiments the rate of drop generation is adjusted in accordance with sensed variations in the movement of the support and/or the pattern of cells on the support. In some preferred embodiments the flight of drops to their predetermined locations is guided by selectively formed electrostatic fields. In another aspect the deposition of the drops at predetermined locations on the support is assisted by predetermined liquid surface tension effects implemented by treatment of the support. In other preferred embodiments the accurate flight of drops to their predetermined support sites is facilitated by controlling the atmosphere along the flight path. The above and other advantageous features of the present invention will become more apparent from the subsequent, more detailed description of the preferred embodiments.

BRIEF DESCRIPTION OF THE DRAWINGS

The description of preferred embodiments of the present invention refers to the attached drawings wherein:

FIG. 1 is an enlarged plan view of one form of photographic element which can be fabricated advantageously in accordance with the present invention;

FIG. 2 is a cross-sectional view taken along the line II—II of FIG. 1.

DETAILED DESCRIPTION OF THE PREFERRED EMBODIMENTS

Figure 3:
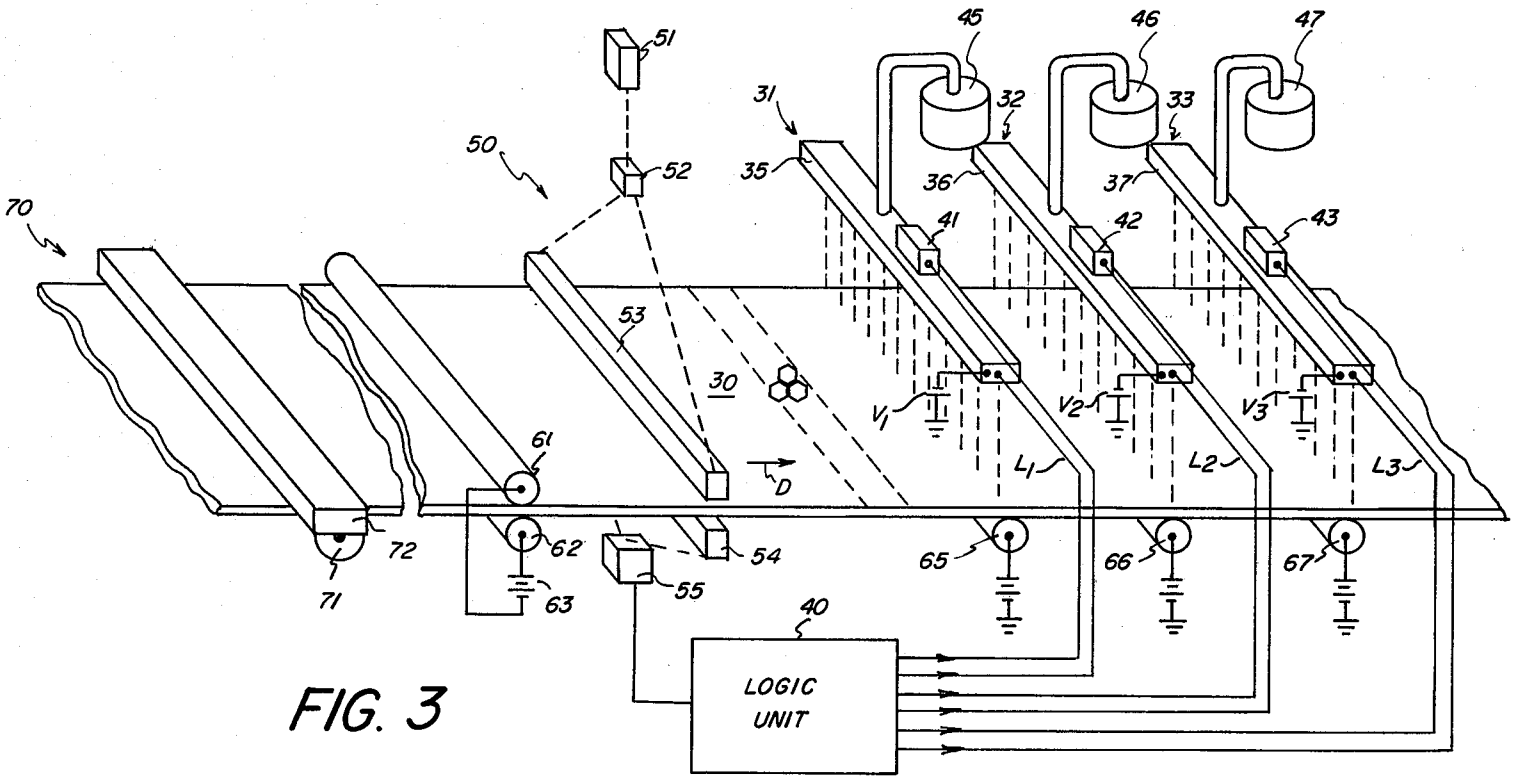
FIG. 3 is a perspective schematic view illustrating one preferred apparatus and procedure for fabricating photographic elements in accordance with the present invention.

The photographic element 10 shown in FIGS. 1 and 2 in general comprises a photographic support 11 and a plurality of photographic imaging material portions denoted A, B and C. It will be noted that across one major surface the support 11 has a network of cell walls 12 that upstand from lower portions of that support surface, which provide cell bottoms 13. Thus the cell walls 12 and bottoms 13 define a plurality of minute, open-topped cells for discretely containing photographic material, the designation A, B or C of which in these Figures respectively denotes one of three different kinds of photographic imaging materials.

It should be noted that for purpose of illustration, FIG. 2 is significantly distorted, the typical thickness being much greater in relation to the cell size than is shown. As pointed out in the aforementioned Whitmore application, typical widths for such cells are in the range of from about 1 to 200 microns, preferably from about 4 to 100 microns. Also as pointed out in the Whitmore application, the depths of the cells can vary considerably depending on the the application involved, depths ranging from about 1 to about 1000 microns, but more typically ranging from about 5 to 50 microns. Typical wall thicknesses are in the range of from about 0.5 to 5.0 microns. The aforementioned Whitmore application provides more teaching regarding particular optimal dimensions and is incorporated herein by reference for that purpose, as well as for its teachings of the variety of useful cell shapes and patterns.

A comprehensive list of operable and preferred support materials is also provided in the Whitmore application, typical supports can take the form of any conventional photographic support onto which cell structure has been superimposed. The support can comprise a multilayered structure with a lower layer providing strength and resistance to dimensional change and an upper layer forming the cell structure. Exemplary upper layer materials include conventional photopolymerizable or photocrosslinkable materials (such as photoresist), radiation-responsive colloid compositions, or vehicles and/or binders commonly employed in photographic elements. The cell structure can be formed by exposing photoresist through a suitably prepared mask, by plastic deformation with a suitably profiled embossing tool, radiation etching or by other techniques disclosed in the Whitmore application, which is also incorporated herein by reference with respect to operable and preferred support materials and cell-forming techniques.

A wide variety of photographic imaging materials which can advantageously be deposited in the cells are described in the Whitmore application which is also incorporated herein for that purpose. Typical exemplary materials include radiation-sensitive materials (e.g. silver halide emulsion), imaging materials, mordants, silver precipitating agents and other materials such as filter dyes and pigments which are useful in conjunction with such materials. Herein the terms photographic imaging material and photographic imaging liquid are intended to include all in-cell materials described in the Whitmore application.

It is desirable, for stable drop formation break-up of the liquid jet, that photographic liquids utilized in accordance with the present invention have a relatively high surface tension characteristic and a relatively low viscosity characteristic. Thus aqueous solutions or suspensions are one preferred form of photographic liquid for use in the present invention. However other liquids, e.g. containing organic liquids can be utilized if system parameters such as liquid surface tension, liquid density, liquid viscosity and liquid jet diameter are properly adjusted. That is, higher liquid surface tension and larger jet diameters facilitate the use of more viscous liquids. Temperature of the photographic liquid also can be regulated to control liquid viscosities. It is preferred that liquid viscosity be below about 5 centipoise; however, high viscosity liquids are useful in systems particularly designed to accommodate them. Also, in embodiments of the invention employing electrically charged liquid drops, it is desirable that the liquid have resistivity in the range of about 100 to 5000 ohm-cm. However, other liquid resistivities are useful. Further background regarding useful parameters of the kind described above can be found in the literature pertaining to inks for ink jet printing.

Referring now to FIG. 3, next will be described preferred modes for depositing such photographic liquids on such photographic supports in accordance with the present invention. FIG. 3 illustrates a web of support material 30 having many discrete cells, e.g. such as described in regard to FIGS. 1 and 2, covering its upper surface (only three are shown). The support material 30 is moving in the direction indicated, from an upstream position to coating zones that are located under liquid jet generator means, denoted generally 31, 32 and 33.

The jet generator means, in general, can be one of the many kinds now known in the art of ink jet printing, which is currently in active development. Typically such generator means fall in one of two broad classes, "on-demand" or "continuous." On-demand generators can be of an electrostatically-gated type wherein a drop is formed at a nozzle under low pressure (so that surface tension forces retain it) and released by application of a high voltage between the drop meniscus and a gating electrode (see e.g. U.S. Pat. No. 2,600,129). On-demand generators also can be of the pressure-pulsed type which utilize a transducer element, e.g. a piezoelectric crystal, that is selectively energized to generate compressive force on a body of liquid to thus propel a drop of the liquid through an orifice to a deposition zone. Exemplary pressure-pulsed generators are disclosed e.g. in U.S. Pat. Nos. 3,840,758 and 3,857,049. Although the on-demand jet generators are useful in accordance with the present invention, the "continuous" type jet generator is preferred and generator means 31, 32 and 33 shown in FIG. 3 are of this continuous type.

In general, continuous drop stream generators comprise a nozzle, or array of nozzles, through which liquid is forced under pressure in a cylindrical jet. Such a cylindrical jet is unstable and will break up into a series of drops. If the jet is subject to a vibration of frequency near that corresponding to the fastest growing natural disturbance within the jet (Rayleigh calculated this to be $\lambda=4.51\times$ the jet diameter), the jet can be broken up by this vibration. In this mode the jet forms a series of drops, each of volume equal to a cylindrical section of the jet, which will be the length of the impressed vibration wavelength.

Thus drop stream generators 31, 32 and 33 each respectively comprise a manifold and nozzle array (35, 36 and 37), an electro-mechanical transducer (41, 42 and 43) for impressing vibrations on the nozzle array and a supply (45, 46 and 47) of pressurized photographic imaging liquid for coating on the support 30. Exemplary configurations useful for such droplet generators are shown in more detail in U.S. Pat. Nos. 3,373,437; 3,596,275; 3,586,907; 3,701,476; 3,701,998; 3,714,928; 3,739,393; 3,805,273 and 3,836,913.

In the usual ink jet generators, including those described in the previously cited patents, an electrostatic charge is impressed on drops as they break from the stream, and electrical deflection fields are provided along the drop stream path to guide the charged drops to the desired destination. In the FIG. 3 embodiment, voltage sources $V_1$, $V_2$ and $V_3$ provide potential to charge the drops, and lines $L_1$, $L_2$ and $L_3$ selectively energize deflector plates under the control of logic unit 40. Although drop charging and field deflection are utilized in the subsequently described liquid jet coating method, it will be understood that in other preferred embodiments according to the present invention, drop deflection is not required.

Thus, support 30 is moved, as indicated in FIG. 3, at substantially constant velocity past the coating stations beneath drop generators 31, 32 and 33, in the direction D indicated in FIGS. 1 and 3. As successive portions of the support move sequentially past the coating stations, drop streams are directed onto predetermined sites of those portions, i.e. into predetermined cells within those portions. That is, the rate of drop generation, the sequence of drop deflection and the velocity of movement of the support past the coating zone are synchronized so that drops from generator 31 are deposited in the A cells of the support, the drops from generator 32 are deposited in the B cells of the support and the drops from generator 33 are deposited in the C cells of the support.

More specifically, consider the drop stream from generator 31, which is supplied with photographic coating liquid A from supply 45. The orifices of the nozzle array and liquid pressure (thus jet velocity) are chosen so that the drop size and rate are compatible with the size and pitch P (see FIG. 1) of cells A of the support and the selected velocity of web movement. Logic unit 40 will therefore impress a frequency on the array causing drop generation at a rate "r" that is equal to the support velocity V divided by the intercell pitch p of cells A in the direction of support movement D. As can be noted in FIG. 1, cells A, of this format, occur in alternate longitudinal rows. Thus logic unit 40 also imparts a deflecting voltage periodically to deflector plates of the drop generator (via line $L_1$) to cause alternate drops to be deflected one line distance (d in FIG. 1). Drop generators 32 and 33 function under control of logic unit 40 in a similar manner to deposit photographic coating liquids B and C respectively in the B and C cell groups of the support 30.

To obtain proper synchronization of the transducers 41, 42 and 43 with the cells on the moving support 30 (and to maintain synchronization in the event of cell pitch variation or support velocity fluctuation), a control unit 50 is located upstream from the coating zones. In its simplest form unit 50 can comprise a detector which identifies cell positions and signals of the logic unit 40 dynamically in accord therewith. As illustrated in FIG. 3, the control unit 50 comprises a laser 51 whose light beam is scanned by acoustooptic deflector 52 across the surface of a lens array 53 (e.g. fiber optics) adapted to direct light through the support to collector array 54. The collector array directs the scanned light to detector 55 which thus provides logic unit 40 with the cell line positions and indications of any deviation in cell position transversely across the support. If desired, selected logic corrections can be applied to individual deflector plates of the generator arrays to correct for transverse variations.

To further enhance the precision of drop deposit in the cells, several additionally preferred modes of operation can be utilized in cooperation with the method just described. Thus, at a location upstream from the coating zones electrostatic charging station 60 can provide a charge (of the same polarity as the droplet charge) on the top surface of the cell walls. In the illustrated embodiment station 60 comprises conductive rollers 61 and 62 and voltage source 63 for creating a potential of proper polarity on roller 61. Thus e.g. a negative charge on cell wall tops will deflect the negatively charged drops toward the center of the cell. This electrostatic guidance is further enhanced by creating a positive bias on the cell bottoms which attracts the positively charged drops. Positively biased rollers 65, 66, 67 provided this effect.

Another preferred droplet guidance enhancement procedure, useful in cooperation with the present invention, is illustrated by pre-coating station 70. There a roller 71 applies to the top of the cell walls, from supply 72, a layer of material to which the photographic coating liquids are hydrophobic. Thus, the photographic coating drops seek the relatively hydrophilic cell interiors in preference to the tops of cell walls. One skilled in the art will appreciate that if the photographic coating liquid "prefers" a hydrophobic surface, the cells can be relatively hydrophobic.

To avoid unwanted disturbance of the droplet's flight, it is preferred in accordance with the present invention to evacuate the atmosphere along the path from generators 31, 32 and 33 to the support. This can be accomplished by conventional means (not shown).

One skilled in the art will appreciate that various modifications of the specifically disclosed procedure are within the scope of the invention. For example, it would be equivalent to move the drop generator instead of the support or to move both to provide a predetermined relative velocity. Also it will be appreciated that the present invention has utility in coating supports which do not have cell walls. Thus, the invention has been described in detail with particular reference to certain preferred embodiments thereof, but it will be understood that variations and modifications can be effected within the spirit and scope of the invention.

What is claimed is:

1. A method of coating a photographic support of the kind having a major surface of substantially uniform transverse dimension and a plurality of cell walls upstanding from said surface in a regular pattern to define a plurality of minute, open-topped, discrete cells, said method comprising:

(a) moving said support through a coating zone in a direction orthogonal to said transverse dimension and at a substantially constant velocity;

(b) generating at least one stream of equally sized and spaced drops of photographic coating liquid directed toward the coating zone; and (c) synchronizing the support movement and the rate of drop generation so that the drops of said stream are deposited in predetermined cells of said support.

2. The method defined in claim 1 further comprising the step of adjusting the generating of said drops in response to variation in said moving support velocity.

3. The method defined in claim 1 further comprising the steps of electrostatically charging the drops of coating liquid of said stream and forming a predetermined electrostatic charge pattern on said support at a location upstream from said coating zone whereby electrostatic forces assist in guiding said drops into said cells.

4. The method defined in claim 3 wherein said drops are charged to a first polarity and said support charge pattern is formed by charges of said first polarity on cell wall tops.

5. The method defined in claim 4 further including the step of electrically biasing the back of the support to a polarity opposite said first polarity.

6. The method defined in claim 1 further including the steps of forming cell wall interiors of said support relatively hydrophilic and cell wall tops of said support relatively hydrophobic with respect to said drops whereby surface tension forces of said drop assist in locating said drops in the cells.

7. The method defined in claim 1 further comprising the steps of electrostatically charging the drops of coating liquid in said stream, sensing the location of said predetermined cells at a position upstream from said coating zone and electrostatically deflecting said drops in response to such sensing to direct said drops into said cells.

8. The method defined in claim 1 wherein said stream generating step comprises generating a plurality of droplet streams respectively directed toward different transverse portions of said coating zone.

9. The method defined in claim 8 wherein respective different groups of said plurality of droplet streams respectively comprise different photographic coating liquids.

10. The method defined in claim 1 wherein said generating step comprises generating a plurality of droplet streams respectively directed toward different longitudinally staggered portions of said coating zone.

11. The method defined in claim 10 wherein said longitudinally staggered streams respectively comprise different photographic coating liquids.

12. The method defined in claim 11 wherein the rate of drop generation for said plurality of streams is synchronized with respect to the movement of said web so that different photographic coating liquid drops are longitudinally interlaced in respective cells on said photographic support.

13. The method defined in claim 1 further comprising the steps of electrostatically charging the drops of coating liquid of said stream and electrostatically deflecting the different drops in said stream in a direction transverse to the direction of support movement by different respective magnitudes.

14. The method defined in claim 1 further comprising the step of reducing the pressure of the atmosphere through which said stream passes to said support.

* * * * *